US010544555B1

(12) United States Patent
Lim et al.

(10) Patent No.: US 10,544,555 B1
(45) Date of Patent: Jan. 28, 2020

(54) ROADWAY BARRIER APPARATUS

(71) Applicant: LINDSAY TRANSPORTATION SOLUTIONS, INC., Rio Vista, CA (US)

(72) Inventors: Jason T. Lim, Stockton, CA (US); Jeffrey M. Thompson, Sacramento, CA (US); Richard Boston, Vacaville, CA (US)

(73) Assignee: Lindsay Transportation Solutions, Inc., Rio Vista, CA (US)

( * ) Notice: Subject to any disclaimer, the term of this patent is extended or adjusted under 35 U.S.C. 154(b) by 0 days.

(21) Appl. No.: 16/190,498

(22) Filed: Nov. 14, 2018

(51) Int. Cl.
*E01F 15/08* (2006.01)

(52) U.S. Cl.
CPC ..... *E01F 15/088* (2013.01); *E01F 15/08* (2013.01)

(58) Field of Classification Search
CPC ..... E05D 2011/1035
USPC ..... 404/6; 16/252, 286; 403/328
See application file for complete search history.

(56) References Cited

U.S. PATENT DOCUMENTS 3,375,546 A * 4/1968 Peterson ..... E05D 7/1044 16/258
3,749,435 A * 7/1973 Balzano ..... E05B 47/0047 292/341.16
3,874,029 A 1/1975 McCullough
4,806,044 A 2/1989 Duckett
4,828,425 A 5/1989 Duckett
5,040,268 A 8/1991 Knurr
5,410,785 A * 5/1995 Huang ..... A44B 11/2592 24/635
5,412,842 A 5/1995 Riblett
6,439,802 B1 * 8/2002 Duckett ..... E01F 15/006 404/6
6,474,904 B1 * 11/2002 Duckett ..... E01F 15/086 256/13.1
6,632,044 B2 10/2003 Duckett
6,837,647 B2 1/2005 Tagg
6,908,222 B2 * 6/2005 Brunswick ..... A47J 43/0705 366/331
6,941,617 B2 * 9/2005 Pinto ..... E05D 5/04 16/297
6,981,750 B2 * 1/2006 Krampotich ..... H05K 7/1448 16/380
7,140,802 B2 * 11/2006 Lamore ..... E01F 13/028 404/6
7,168,727 B2 * 1/2007 Dick ..... B60D 1/06 280/491.5
7,393,154 B1 7/2008 Dyke et al.
7,654,768 B1 * 2/2010 Tullis ..... E01F 13/12 256/13.1
7,708,492 B2 5/2010 Carey
7,805,811 B2 * 10/2010 Shuker ..... E05D 5/128 16/380

(Continued)

FOREIGN PATENT DOCUMENTS

FR 2826024 12/2002

*Primary Examiner* — Thomas B Will
*Assistant Examiner* — Katherine J Chu
(74) *Attorney, Agent, or Firm* — Thomas R. Lampe

(57) ABSTRACT

Roadway barrier apparatus including roadway barrier modules disposed end to end and pivotally connected together by a pivot pin positioned in aligned apertures of connector brackets at the ends of the modules, the pivot pin having a groove and a spring biased hinge pusher member positionable in the groove to limit upward movement of the pivot pin.

2 Claims, 3 Drawing Sheets

(56) References Cited

U.S. PATENT DOCUMENTS

| | | | | |
|---|---|---|---|---|
| 8,376,651 | B2 * | 2/2013 | Kulp | E01F 15/086 256/13.1 |
| 8,939,675 | B2 | 1/2015 | Christensen et al. | |
| 9,038,242 | B2 * | 5/2015 | Chung | E05D 7/0415 16/240 |
| 9,068,382 | B1 | 6/2015 | Hall | |
| 9,789,893 | B2 * | 10/2017 | Young | B62B 7/12 |
| 2005/0084326 | A1 * | 4/2005 | Costa Claver | F16B 5/0614 403/328 |

* cited by examiner

ROADWAY BARRIER APPARATUS

TECHNICAL FIELD

This invention relates to roadway barrier apparatus and more particularly to an improved apparatus incorporating pivotally connected roadway barrier modules.

BACKGROUND OF THE INVENTION

Pivotally connected roadway barrier modules are well known and interconnection between the modules is commonly accomplished by use of connector pins hingedly connecting the roadway barrier modules.

Under certain conditions a connector pin of conventional type is subject to a ratcheting load that can push the pin up and out of position during pickup and placement of the barrier. It is known to put a retaining clip on the pin but it is cumbersome and difficult to apply and remove. Further, such an approach has challenges with forces. In some cases special tools are required to place or remove the connector pin.

The following patent documents disclose arrangements which are believed to be representative of the current state of the art in this field: U.S. Pat. No. 9,068,382, issued Jun. 30, 2015, U.S. Pat. No. 8,939,675, issued Jan. 27, 2015, U.S. Pat. No. 7,708,492, issued May 4, 2010, U.S. Pat. No. 6,837,647, issued Jan. 4, 2005, U.S. Pat. No. 5,412,842, issued May 9, 1995, U.S. Pat. No. 5,040,268, issued Aug. 20, 1991, U.S. Pat. No. 4,828,425, issued May 9, 1989, U.S. Pat. No. 4,806,044, issued Feb. 21, 1989, U.S. Pat. No. 3,874,029, issued Apr. 1, 1975, U.S. Pat. No. 7,393,154, issued Jul. 1, 2008, U.S. Pat. No. 6,632,044, issued Oct. 14, 2003, and French Patent No. FR2826024, dated Oct. 29, 2004.

BRIEF SUMMARY OF THE INVENTION

The roadway barrier apparatus of this invention includes a first roadway barrier module having a double-ended first module body and upper and lower first module connector brackets extending from each end thereof. The upper and lower first module connector brackets are spaced a fixed vertical distance from one another and define aligned first module bracket apertures.

The apparatus also includes a second roadway barrier module having a double-ended second module body and upper and lower second module connector brackets extending from each end thereof. The upper and lower second module connector brackets are spaced a fixed vertical distance from one another and define aligned second module bracket apertures.

The first module body and the second module body are disposed with opposed ends thereof spaced from one another. The upper first and second module connector brackets thereof are in overlapping relationship and the lower first and second module connector brackets are in overlapping relationship with the first module bracket apertures and the second module bracket apertures being aligned.

A spring biased hinge pusher member is slidably connected to the first module body and extends toward the second module body.

A pivot pin is positioned between the first module body and the second module body in the aligned apertures of the first and second module bar connector brackets and extends through said upper and lower first and second module connector brackets.

The pivot pin has a circumferentially extending groove. The pivot pin includes a pivot pin top portion above the topmost upper module connector bracket and the spring biased hinge pusher member is positioned in the circumferentially extending groove to limit upward movement of the pivot pin and prevent disengagement of said pivot pin from the overlapping upper and lower connector brackets due to ratcheting effect caused by relative motion between the first and second roadway barrier modules.

Other features, advantages and objects of the present invention will become apparent with reference to the following description and accompanying drawings.

DETAILED DESCRIPTION OF THE INVENTION

Figure 1:
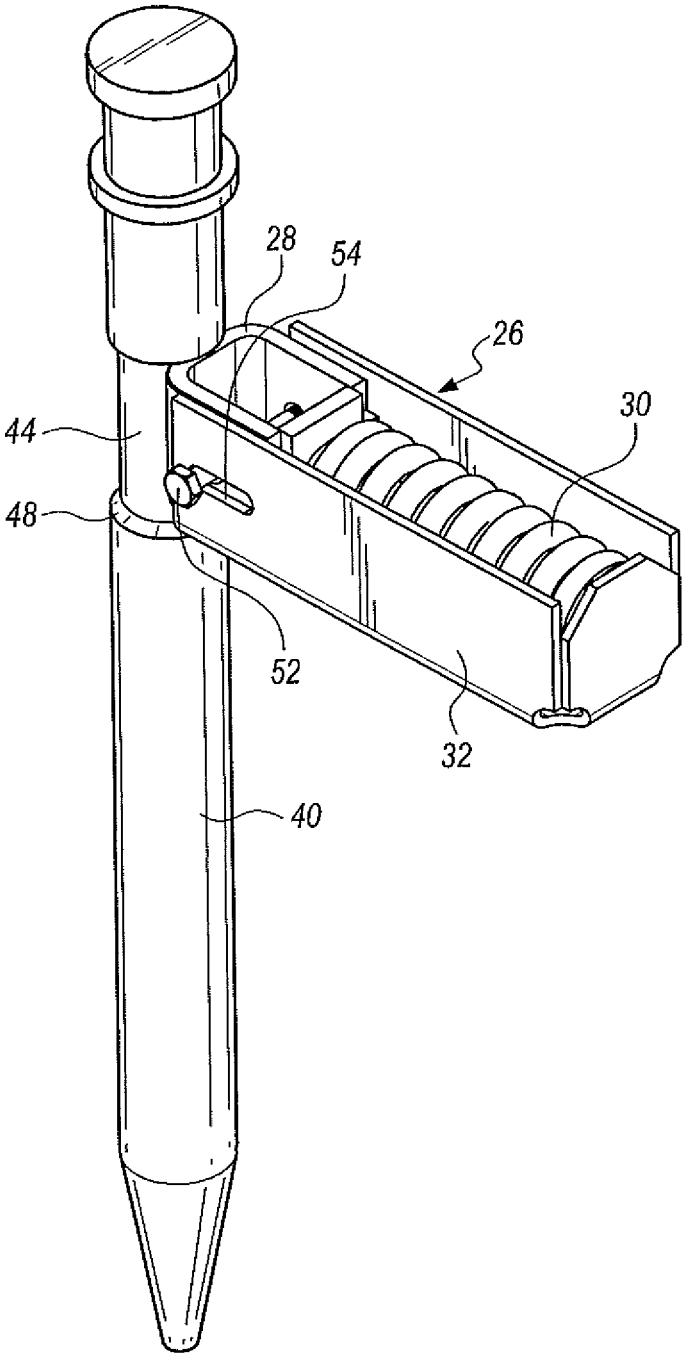
FIG. 1 is a perspective view of an assembly including a pivot pin constructed in accordance with the teachings of the present invention in operative association with a spring biased hinge pusher member positioned in a guide structure.
Figure 2:
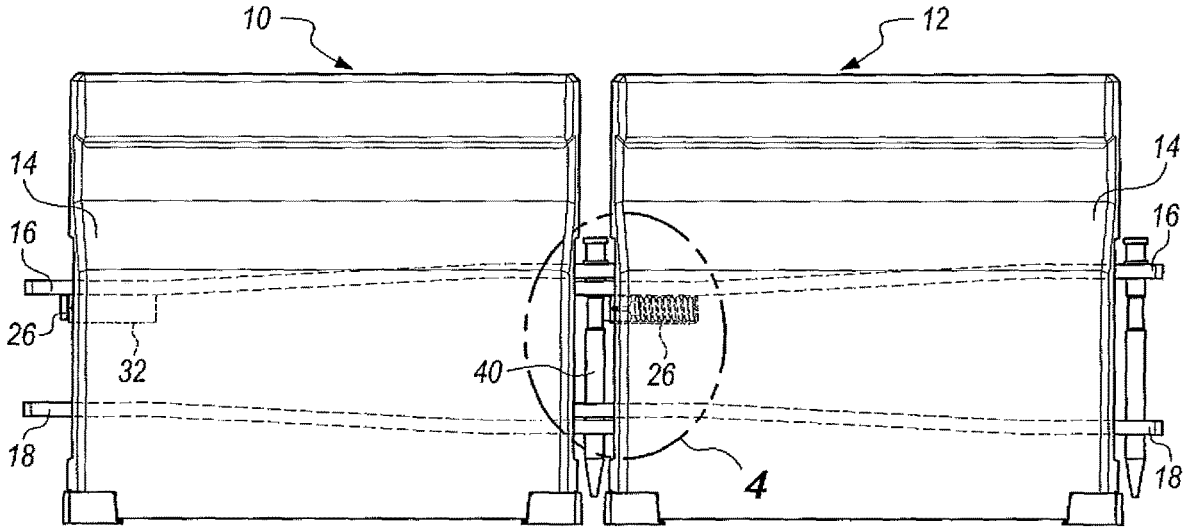
FIG. 2 shows two roadway barrier modules connected by the pivot pin of the present invention extending through connector brackets of the modules, the assembly illustrated in FIG. 1 located in a cavity of the roadway barrier modules.
Figure 3:
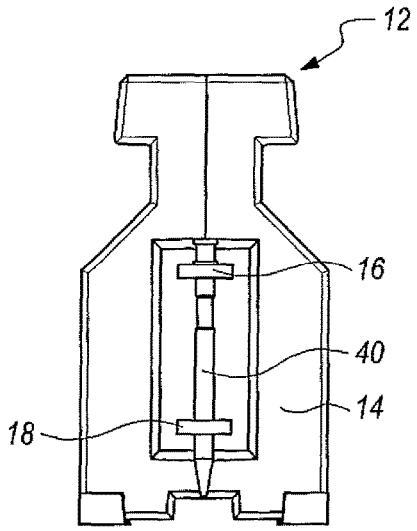
FIG. 3 is a front, elevational view illustrating one of the roadway barrier modules having the pivot pin positioned in and extending through the upper and lower connector brackets thereof.
Figure 4:
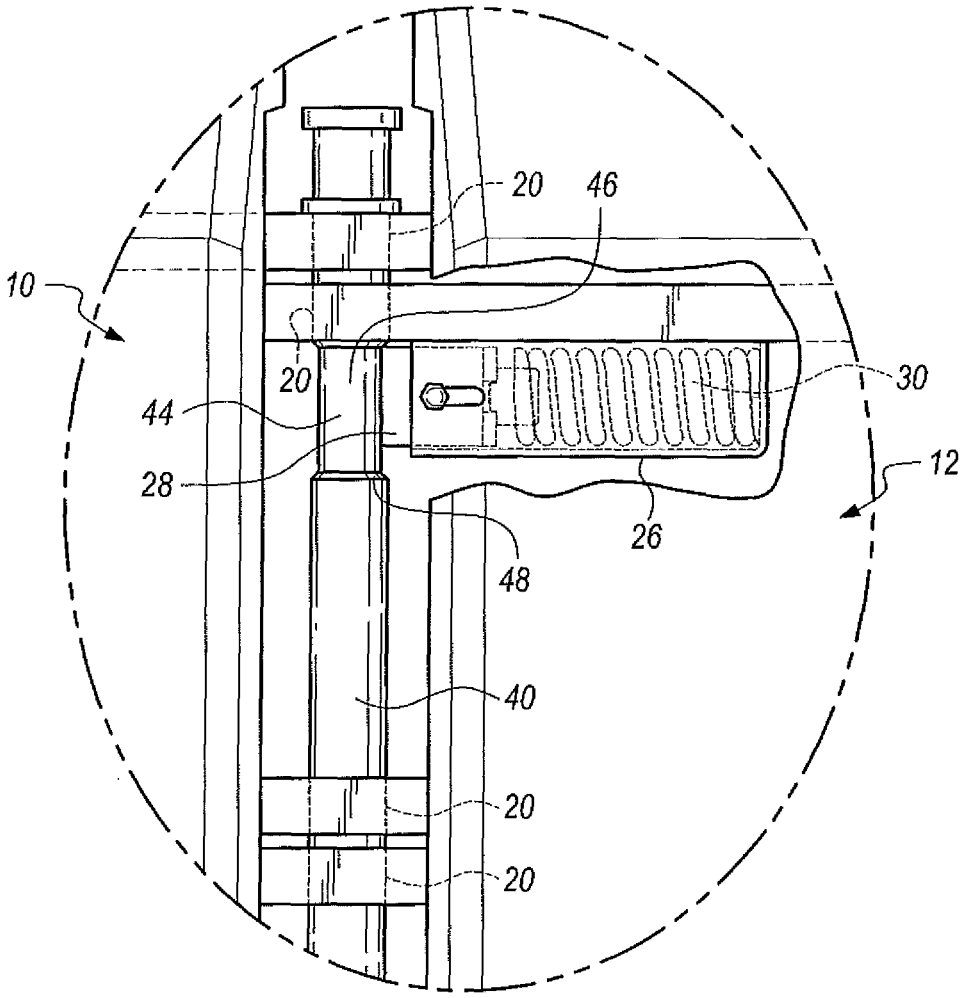
FIG. 4 is an enlarged, elevational view of the drawing portion indicated in FIG. 2 by reference numeral 4.
Figure 5:
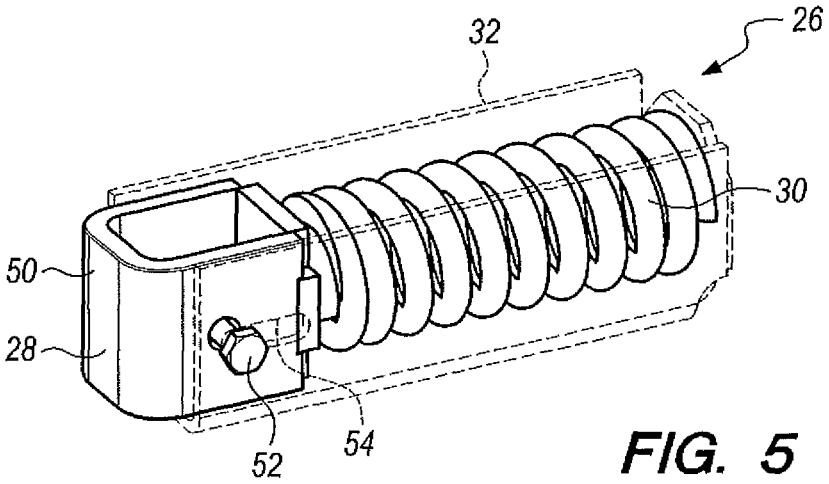
FIG. 5 is an enlarged, perspective view of the assembly hinge pusher member and spring, the guide structure shown in dash lines.

The present invention is directed to roadway barrier apparatus comprising a plurality of pivotally connected roadway barrier modules, the roadway barrier modules interconnected by structure of the present invention. Two such roadway barrier modules 10 and 12 are shown, but it is of course to be understood that they typically are utilized in a longer string of roadway barrier modules.

The illustrated arrangement includes roadway barrier modules 10, 12 of like construction. Each roadway barrier module has a double-ended module body 14. In the illustrated embodiment the roadway barrier module bodies are of steel reinforced concrete but the principles of this invention apply to other module body constructions. Each roadway barrier module has an elongated upper module connector bracket 16 extending from both ends thereof. Lower module connector brackets 18 of the barrier modules also extend from both ends of the module body, the upper and lower module connector brackets spaced from one another and defining aligned module bracket apertures 20.

The module bodies 14 of the roadway barrier modules 10, 12 are disposed with opposed ends thereof spaced from one another and the upper first and second module connector brackets 16, 18 thereof in overlapping relationship. The module bracket apertures thereof are aligned, as is conventional.

In the drawings an assembly 26 is shown positioned in a cavity of module bodies 14. The assembly 26 includes a hinge pusher member 28, a spring 30 and a guide structure 32 which accommodates the hinge pusher member 28 and spring 30. The pusher member 28 in the assembly in second module 12 is urged in the direction of the module body 14 of roadway barrier module 10.

A pivot pin 40 is positioned between the module bodies 14 of roadway barrier modules 10, 12. The pivot pin 40 is in the aligned apertures 20 at the ends of the module body connector brackets 16, 18 and extends through both the overlapped upper and lower module connector brackets.

The pivot pin 40 has the circumferentially extending groove 44 defined by upper circular chamfered surface 46 and lower circular chamfered surface 48. The hinge pusher member 28 is positioned in the groove 44 to limit upward movement of the pivot pin and prevent disengagement of the pivot pin from the overlapping upper and lower connector brackets due to ratcheting effect caused by relative motion between the first and second roadway barrier modules. The pin contact surface 50 of the hinge pusher member engages the pin between the upper and lower chamfered surfaces. The path and placement of the hinge pusher member 28 is controlled by a guide projection 52 attached to the hinge pusher member 28 and positioned in a slot 54 of the guide structure.

The chamfered circular surfaces facilitate removal of the pin from the module connector brackets when desired.

The invention claimed is:

1. Roadway barrier apparatus comprising, in combination:

a first roadway barrier module having a double-ended first module body and upper and lower first module connector brackets extending from each end thereof, said upper and lower first module connector brackets spaced a fixed vertical distance from one another and defining aligned first module bracket apertures, said upper and lower first module connector brackets affixed to said first roadway module and immovable relative thereto;

a second roadway barrier module having a double-ended second module body and upper and lower second module connector brackets extending from each end thereof, said upper and lower second module connector brackets spaced from one another and defining aligned second module bracket apertures, said upper and lower second module connector brackets affixed to said second roadway module and immovable relative thereto, the first module body and the second module body being disposed with opposed ends thereof spaced from one another and the upper first and second module connector brackets thereof in overlapping relationship and the lower first and second module connector brackets in overlapping relationship with the first module bracket apertures and the second module bracket apertures aligned;

an assembly including a guide structure disposed in a cavity formed in said first module body and further including a spring biased hinge pusher member within said guide structure slidably connected to the first module body extending from the first module body toward the second module body and continuously biased toward the second module body; and a pivot pin positioned between said first module body and said second module body in said aligned apertures of said first and second module body connector brackets and extending through said upper and lower first and second module connector brackets, said pivot pin having a circumferentially extending groove defined by upper and lower circular chamfered surfaces, said pivot pin including a pivot pin top portion above the topmost upper module connector bracket and said spring biased hinge pusher member positioned in said circumferentially extending groove to limit upward movement of said pivot pin and prevent disengagement of said pivot pin from said overlapping upper and lower connector brackets due to ratcheting effect caused by relative motion between the first and second roadway barrier modules, said pusher member having a pin contact surface engaging said pin between said upper and lower circular chamfered surfaces.

2. The roadway barrier apparatus according to claim 1 including a guide projection attached to the hinge pusher member slidable in a slot in the guide structure.

* * * * *